US005784244A

United States Patent [19]

Moran et al.

[11] Patent Number: 5,784,244

[45] Date of Patent: Jul. 21, 1998

[54] CURRENT LIMITING CIRCUIT

[75] Inventors: Richard Jerome Moran, Milwaukee; Daniel James Schreiber, New Berlin; Ronald Arvid Wainio, South Milwaukee, all of Wis.

[73] Assignee: Cooper Industries, Inc., Houston, Tex.

[21] Appl. No.: 713,648

[22] Filed: Sep. 13, 1996

[51] Int. Cl.[6] ..... H01H 47/10

[52] U.S. Cl. ..... 361/154; 361/152

[58] Field of Search ..... 361/152–156

[56] References Cited

U.S. PATENT DOCUMENTS

| | | | |
|---|---|---|---|
| 1,142,852 | 6/1915 | Simon . | |
| 3,123,746 | 3/1964 | Wachowiak . | |
| 3,356,910 | 12/1967 | Bushnell | 361/154 |
| 3,443,255 | 5/1969 | Massar . | |
| 3,582,718 | 6/1971 | Spellman | 361/154 |
| 3,582,981 | 6/1971 | Dalyai | 361/155 |
| 3,852,646 | 12/1974 | Mason | 361/154 |
| 3,959,713 | 5/1976 | Davis et al. . | |
| 4,291,358 | 9/1981 | Dettmann et al. | 361/154 |
| 4,318,154 | 3/1982 | DePuy | 361/155 |
| 4,336,564 | 6/1982 | Wisniewski et al. | 361/154 |
| 4,360,855 | 11/1982 | Ohba | 361/154 |
| 4,376,476 | 3/1983 | Hagiri . | |
| 4,511,945 | 4/1985 | Nielsen . | |
| 4,536,818 | 8/1985 | Nielsen . | |
| 4,563,721 | 1/1986 | Schroether . | |
| 4,658,320 | 4/1987 | Hongel . | |
| 4,720,763 | 1/1988 | Bauer | 361/154 |
| 4,947,283 | 8/1990 | Kono | 361/154 |
| 5,018,366 | 5/1991 | Tanaka et al. | 361/154 |
| 5,113,307 | 5/1992 | Meyer et al. | 361/154 |
| 5,128,825 | 7/1992 | Hurley et al. | 361/154 |
| 5,283,707 | 2/1994 | Conners et al. . | |
| 5,347,419 | 9/1994 | Caron et al. . | |
| 5,410,187 | 4/1995 | Meyer | 361/154 |
| 5,475,560 | 12/1995 | Onishi et al. . | |
| 5,546,268 | 8/1996 | Hurley et al. | 361/154 |
| 5,568,349 | 10/1996 | Kowalewski | 361/154 |

FOREIGN PATENT DOCUMENTS 56-45005A 4/1981 Japan .

OTHER PUBLICATIONS

Published Australian Patent Applicaton No. AU–A–47333/93, "A Charging Circuit", filed by Nu–Lec Pty Ltd. published on Mar. 24, 1994.

*Primary Examiner*—Fritz Fleming

*Attorney, Agent, or Firm*—Burns, Doane, Swecker & Mathis, L.L.P.

[57] ABSTRACT

An electronic circuit, and corresponding method, for controlling the closing velocity of electrical switchgear, includes an actuator and a current detection circuit that detects whether an optimum amount of current is flowing through the actuator. When the optimum amount of current is detected, a current optimizing resistor is inserted into the path of the current flowing through the actuator, thus limiting the current flowing through the actuator to the optimum amount. This, in turn, limits the closing velocity of the electrical switchgear and minimizes contact bounce.

19 Claims, 4 Drawing Sheets

CURRENT LIMITING CIRCUIT

BACKGROUND

The present invention relates to devices for controlling electrical switchgear. More particularly, the present invention relates to a method and a device for controlling the closing velocity of electrical switchgear.

In power distribution systems, switchgear are used to protect system equipment and system loads. Switchgear provide protection by opening and closing sections of the system in response to abnormal load conditions (e.g., overcurrent conditions).

Typically, switchgear are vacuum enclosed, electromechanical devices, for example, reclosers and fault interrupters. The electrical contacts are contained within the vacuum enclosure, wherein one contact is fixed and the other contact is attached to a moveable operating member which extends through the vacuum seal enclosure. Electromechanical conversion devices, such as solenoids, or electro-magnetic conversion devices, such as bi-stable magnetic actuators, are employed to move the operating member into the open and closed positions.

In conventional systems, during a closing operation, the switchgear contacts are driven together by a solenoid, for example, at such a high velocity that the contacts tend to bounce, i.e., they rapidly open and close a number of times before coming to rest in a closed position. This is undesirable because the contacts generally wear out quite rapidly, thus unnecessarily shortening the life of the switchgear. Other undesirable results include prestrike and welding.

One method that has been used to limit the closing velocity of switchgear involves the charging of a capacitor to a known energy level. Then, the energy stored in the capacitor is used to drive the solenoid, which in turn, drives the switchgear operating member. Unfortunately, the total amount of energy stored in a given capacitor can vary substantially depending upon the age of the capacitor, the ambient temperature surrounding the capacitor, and the design tolerances of the capacitor. This means that the amount of energy discharged through the solenoid, and the number of ampere turns generated by the solenoid to actuate the switchgear operating member, will vary substantially. In some cases, the energy stored on the capacitor can vary as much as −25 percent to +15 percent. Thus, using capacitors alone to limit the amount of energy applied to the solenoid will not eliminate contact bounce, premature wear-and-tear of the contacts, and other related problems such as prestrike and welding.

SUMMARY

The present invention more effectively controls the closing operation of electrical switchgear by providing a current sensing circuit which determines whether the current flowing through the electro-magnetic or electromechanical conversion device has reached a desired or optimum current level required to move the conversion device plunger, and hence the operating member of the switchgear. When the desired current level has been detected, an optimum resistance is inserted into the path of the current being applied to the solenoid, thus limiting the current level to the desired amount, even though the energy source (e.g., a charged capacitor) may contain an excessive amount of energy to drive the solenoid.

It is an object of the present invention to provide an optimized closing velocity for electrical switchgear.

It is another object of the present invention to provide an optimized closing velocity by limiting the amount of current applied to the electromechanical or electro-magnetic conversion device to an optimum level so that the closing velocity of the electrical switchgear is not highly dependent upon excess energy stored in the energy source.

In accordance with one aspect of the present invention, the foregoing and other objects are achieved by a device for limiting an electrical switchgear closing velocity comprising: an energy source; an actuator means connected in series with said energy source, wherein said actuator means mechanically operates the electrical switchgear; current sensing means connected to said actuator means for detecting whether a predetermined amount of current is flowing through said actuator means; current optimizing impedance means; and means for inserting said current optimizing impedance means in series with said energy source and said actuator means in response to said current sensing means detecting the predetermined amount of current flowing through said actuator means.

The aforementioned and other objects of the present invention are also achieved by an electronic circuit for limiting an electrical switchgear closing velocity comprising: an energy source; an electro-magnetic actuator comprising a permanent magnet, a coil, and a plunger, wherein said coil is connected in series with said energy source and said plunger mechanically controls the closure of the electrical switchgear when the energy source discharges its energy through said electro-magnetic actuator; a coil current sensing circuit connected to said electro-magnetic actuator for detecting whether a predetermined amount of current is flowing through the coil of said electro-magnetic actuator; a current optimizing resistor; and means for inserting said current optimizing resistor in series with said energy source and said coil in response to the coil current sensing circuit detecting the predetermined amount of current flowing through said coil.

The aforementioned and other objects of the present invention are achieved by a method for limiting an electrical switchgear closing velocity comprising the steps of: generating a coil current through an actuator, wherein the actuator is connected to the electrical switchgear; detecting whether the coil current has reached a predetermined amount of current for operating the actuator; and limiting the coil current to a predefined coil current profile, thereby limiting the closing velocity of the electrical switchgear in accordance with the predefined coil current profile.

BRIEF DESCRIPTION OF THE DRAWINGS

The objects and advantages of the invention will be understood by reading the following detailed description in conjunction with the following drawings in which.

DETAILED DESCRIPTION

The present invention is designed to ensure that the closing velocity of electrical switchgear is optimized during a closing operation. The invention ensures this by providing a current limiting device that is relatively independent of the amount of energy stored in the energy source, which is typically a closing capacitor. By optimizing the closing velocity, the invention significantly minimizes contact bounce for the switchgear contacts, contained within the switchgear vacuum interrupter, when they come together toward the end of the closing operation. This, in turn, minimizes the occurrence of prestrike, welding, and abnormally excessive wear-and-tear on the contacts.

Figure 1:
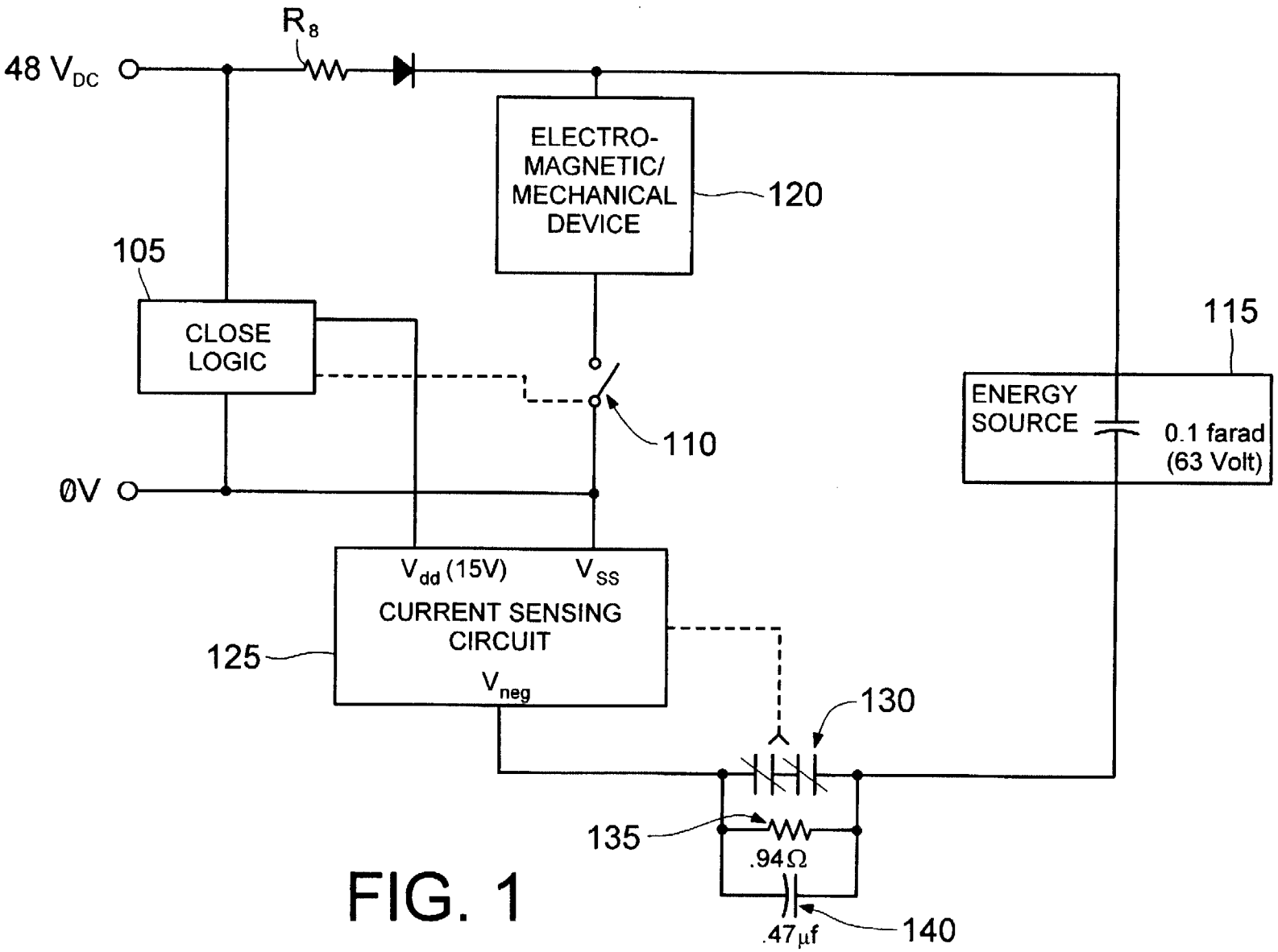
FIG. 1 depicts a block diagram of the present invention.

FIG. 1 depicts an exemplary embodiment of the present invention in block diagram form. During a typical switchgear closing operation, the close logic circuitry 105 will generate a close pulse. In the exemplary embodiment, the close pulse is approximately 40 milliseconds in duration. The close pulse causes an insulated gate bipolar transistor (IGBT) 110, depicted in FIG. 1 as a switch, to close for a period of time approximating 40 milliseconds. While the IGBT 110 is conducting (i.e., closed), an energy source 115 will discharge through an electro-magnetic conversion device 120, for example, a bi-stable magnetic actuator. In an alternative embodiment, an electromechanical conversion device, such as a solenoid, may be used in lieu of the bi-stable magnetic actuator. Typically, the energy source 115 is a capacitor, as illustrated in FIG. 1, which has been precharged by a battery (not shown) to approximately 48 volts. It is the discharging of the capacitor 115 through the bi-stable magnetic actuator 120 which ultimately causes the actuator plunger to move. The plunger, in turn, causes the switchgear contacts to close.

The plunger, however, does not move instantaneously. Rather, the current flowing through the actuator coil must build up to a sufficient level before the actuator can produce enough ampere turns to move the plunger. The desired or optimum amount of current required to move the actuator plunger will depend upon the actuator design and the amount of energy available in the energy source. In the exemplary embodiment, the desired (i.e., optimum) amount of current required to move the actuator plunger is approximately 37 amperes, and it will require approximately 15 milliseconds for the actuator coil current to reach this current level.

In conventional systems, an excessive amount of energy stored in the energy source (i.e., the capacitor 115) will cause the actuator coil current to exceed the desired or optimum amount of current required to move the plunger. The closing velocity of the plunger will, therefore, be excessive, thus resulting in an uncontrolled switchgear closing operation. To avoid these undesirable results, the present invention includes a current sensing circuit 125. The current sensing circuit 125, which will be described in greater detail below, is designed to detect whether the desired amount of current has built up in the coil of the actuator 120. As stated, the desired or optimum amount of current for the exemplary embodiment is 37 amperes. When the current sensing circuit 125 detects a coil current of 37 amperes, the current sensing circuit causes one or more normally closed relay contacts 130 to open. Upon opening the relay contacts 130, the coil current is diverted through a current optimizing resistor 135. However, one skilled in the art will recognize that impedance devices other than resistors may be used in lieu of the current optimizing resistor 135.

In the exemplary embodiment, the current optimizing resistor 135 is a 0.94 Ω resistor that must be capable of handling a very high wattage (approximately 1000 to 1500 watts) for a short period of time (approximately 30 milliseconds). The insertion of the current optimizing resistor 135 into the coil current path prevents the coil current from exceeding the desired current level. The electrical switchgear closing operation, as a result, proceeds in a slower more controlled manner, thus minimizing contact bounce and the undesirable effects previously mentioned.

In addition, a current clearing capacitor 140 is connected in parallel with the current optimizing resistor 135. The current clearing capacitor 140 is employed to help clear the approximately 37 amperes from the relay contacts 130 immediately after they are opened.

As stated, the close pulse generated by the close logic circuitry 105 is approximately 40 milliseconds in duration, which is just enough time for the solenoid 120 to complete the switchgear closing operation. After the 40 millisecond time period elapses, the IGBT 110 opens, the energy source capacitor 115 is recharged to approximately 48 volts, and the energy that built up on the current clearing capacitor 140 discharges through the current optimizing resistor 135 rather than the relay contacts 130.

Figure 2:
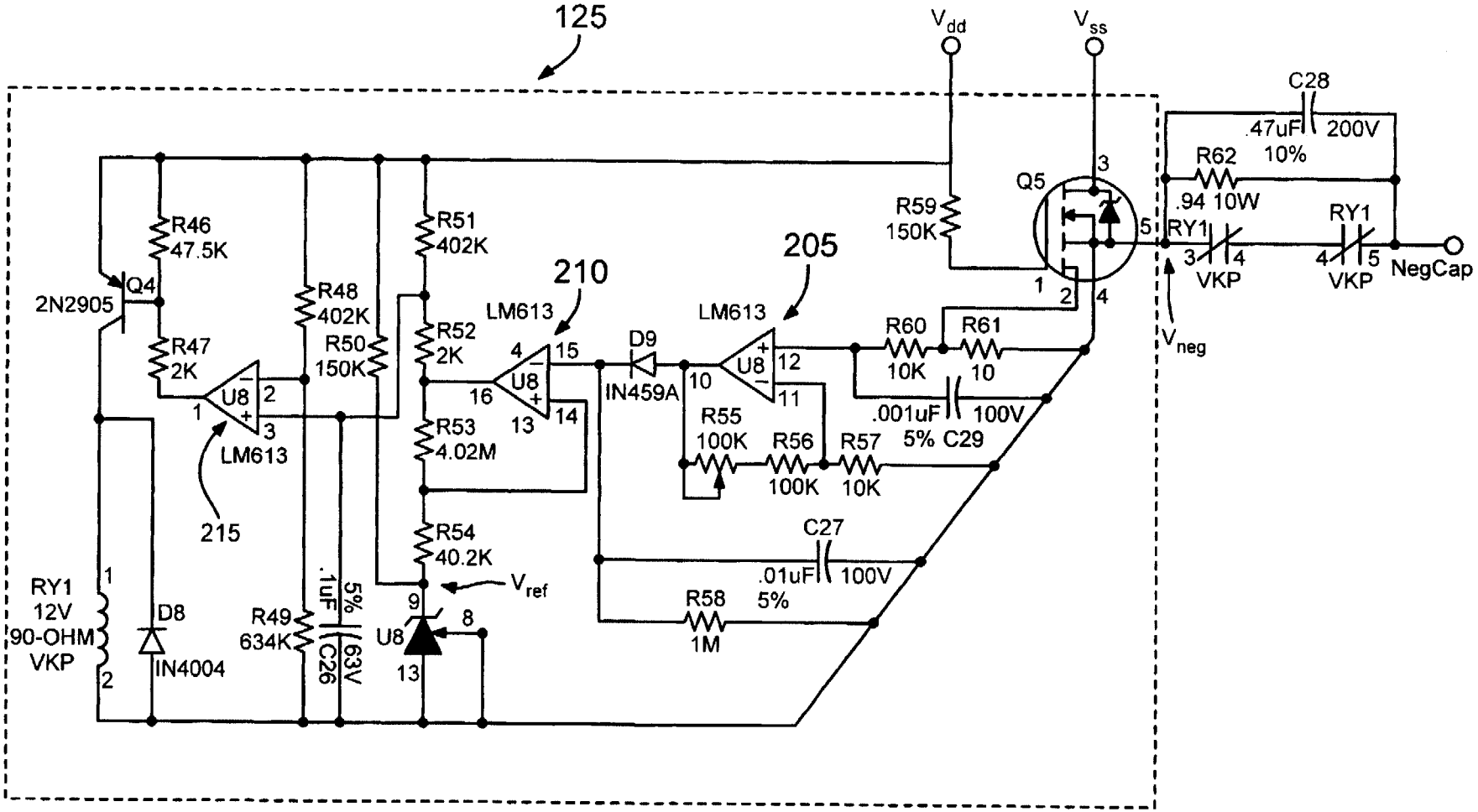
FIG. 2 illustrates an exemplary embodiment of the current sensing circuit.

FIG. 2 illustrates an exemplary embodiment for the current sensing circuit 125, which must detect the desired or optimum coil current required to move the actuator plunger. Briefly, the exemplary embodiment depicted in FIG. 2 has a low voltage (i.e., less than 60 volt) sensefet Q5, an amplification stage, and two comparator stages, the second of which drives a transistor switch which operates the normally closed relay contacts 130. As explained above, the current optimizing resistor 135 is inserted into the path of the coil current when the current sensing circuit 125 opens the relay contacts 130. The operation of the current sensing circuit 125 will now be described in greater detail hereinbelow.

When the close logic 105 generates the close pulse and the IGBT 110 transitions from an OFF state to an ON state, current will begin flowing from the positive terminal of the energy source capacitor 115, through the solenoid coil, into the $V_{ss}$ terminal of the current sensing circuit 125, to the $V_{neg}$ terminal of the current sensing circuit 125, through the normally closed relay contacts 130 (RYI) and back into the negative terminal of the energy source capacitor 115. The current will continue to flow through this path until the current sensing circuit 125 detects that the current level has reached the desired amount required to move the actuator plunger (i.e., 37 amperes for the exemplary embodiment).

The drain, gate and source terminals of the sensefet Q5 are directly connected to the $V_{ss}$, $V_{dd}$ and $V_{neg}$ terminals of the current sensing circuit 125 respectively. As long as energy is being discharged through the actuator 120, pin 2 of the sensefet Q5 generates a signal having a current that is approximately 1/2590 of the current flowing through the actuator coil. When the coil current reaches 37 amperes, the signal on pin 2 of sensefet Q5 will cause a voltage of 0.143 volts to develop across the resistor R61 (i.e., 0.143 volts=(10 ohms *37 amperes)/2590). Transients are then removed from the signal by a filter comprising resistor R60 and capacitor C29. The filtered signal is then passed to an amplification stage comprising operational amplifier 205 and resistors R55, R56, and R57. The amplification stage amplifies the signal by a factor of approximately 15 (i.e., (50 Killiohms+100 Killiohms)/10 Killiohms=15). The amplified signal is then passed through diode D9 and stored in capacitor C27.

As capacitor C27 discharges through resistor R58, a voltage proportional to the coil current is applied to the negative input (pin 15) of a first comparator 210. When the coil current reaches the desired current level (i.e., 37 amperes), the voltage at pin 15 will exceed the bias voltage applied to the positive terminal (pin 14) of the first comparator 210. When this occurs, the first comparator 210 will turn "on", sinking the current at the output of comparator 210 (pin 16). This causes the capacitor C26 to discharge through resistor R52 and the bias voltage at pin 14 to drop by approximately 9.7 percent. The bias voltage at pin 14 before the first comparator 210 turns "on" can be computed as follows.

$$V_{pin14}=V_{ref}+((V_{dd}-V_{ref})*R54/(R51+R52+R53+R54)) \quad (1)$$

Given a $V_{ref}$ of 1.244 volts and a $V_{dd}$ of 14.843 volts, the voltage at pin 14 would be 1.369 volts. The voltage at pin 14 after the first comparator 210 turns "on" can be computed as follows.

$$V_{pin14}=V_{ref}-(R54/(R54+R53)) \quad (2)$$

Given a $V_{ref}$ of 1.244 volts, the voltage at pin 14 would be 1.234 volts.

As the capacitor C26 discharges through R52, the voltage at the positive terminal (pin 3) of a second comparator 215 will begin to decrease. When the voltage at pin 3 drops below the bias voltage at the negative terminal (pin 2), the second comparator 215 will turn "on", sinking the current at the output (pin 1). This will cause the transistor Q4 to turn "on", thus energizing (i.e., opening) the normally closed relay contacts (RY1) 130.

The relay contacts 130, when opened, divert the coil current through the current optimizing resistor 135 (FIG. 2, R62). As previously stated, a current clearing capacitor 140 (FIG. 2, C28) in parallel with the current optimizing resistor 135 is employed to clear the approximately 37 amperes of current from the normally closed relay contacts 130 when they first open.

As the actuator plunger, and hence the operating member of the electrical switchgear, moves toward a closed position, an electromotive force (EMF) will begin to build causing the coil current to drop approximately 50 percent. When this occurs, the first comparator 210 will turn "off" and the capacitor C26 will begin to recharge through resistor R51. After one RC time constant, approximately 40 milliseconds (i.e., 402 killiohms*0.1 microfarad), the voltage at the positive terminal (pin 3) of the second comparator 215 will exceed the bias voltage at the negative terminal (pin 2), causing the second comparator 215 to turn "off". When the second comparator turns "off", so too will the transistor Q4. This causes the relay contacts 130 to close. However, before the second comparator turns "off", the IGBT 110 will have turned "off", thus indicating that the closing operation has been completed, and the current clearing capacitor 140 has discharged its energy through the optimizing resistor 135.

Figure 3:
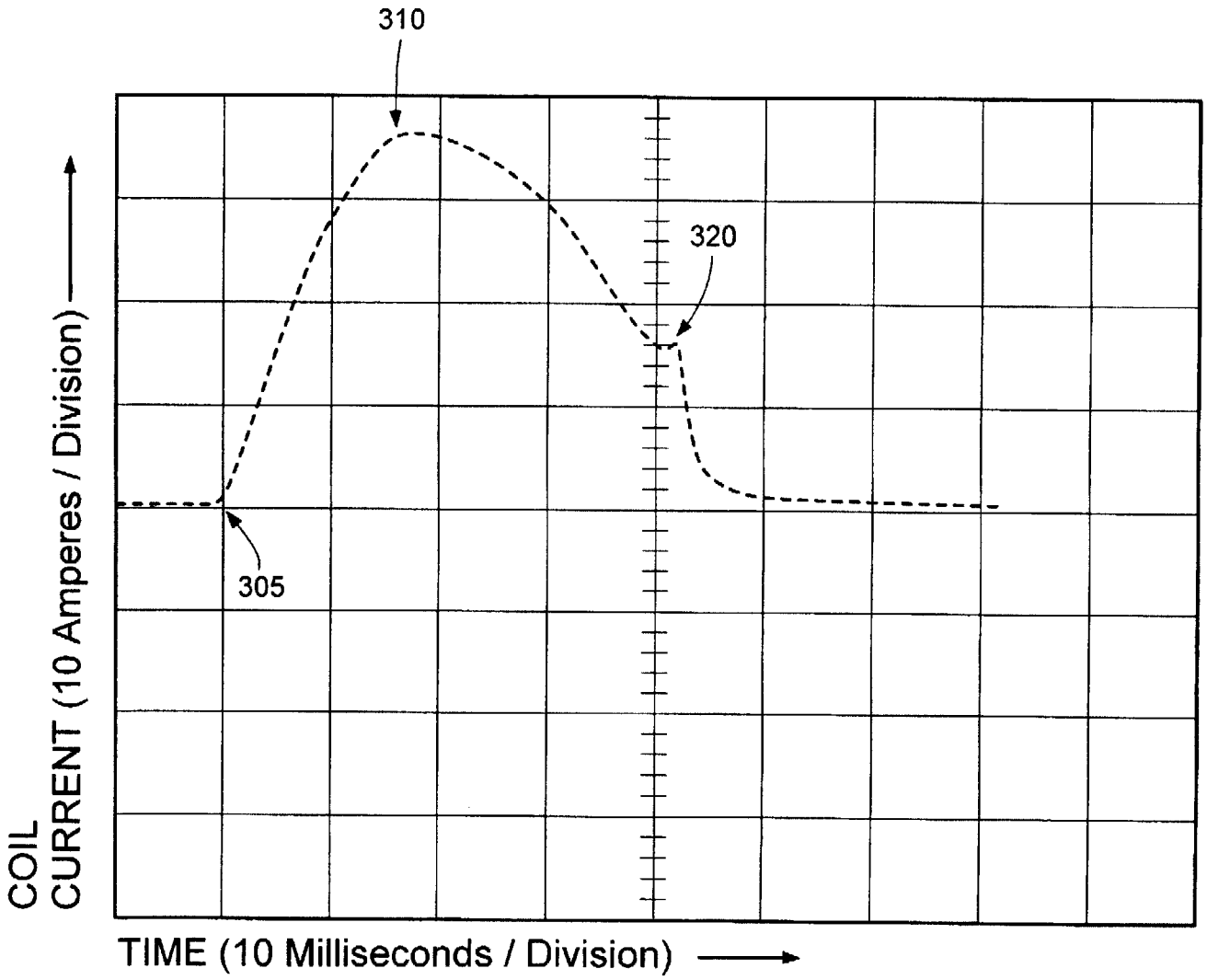
FIG. 3 graphically illustrates the affect the present invention has on coil current during a closing operation.

FIG. 3 illustrates the coil current profile for the exemplary embodiment described above. At time 305, the IGBT 110 closes causing current to begin flowing through the actuator coil. The coil current will continue to increase until time 310 when it reaches the desired or optimum current level required to move the actuator plunger. The current sensing circuit 125 detects the desired current level, opens the one or more relay contacts 130, causing the coil current to flow through the current optimizing resistor 135. As illustrated in FIG. 3, the current optimizing resistor 135 prevents the coil current from exceeding the desired or optimum current level (i.e., 37 amperes for the exemplary embodiment). As the actuator plunger and the switchgear operating member move toward a closed position, a reverse EMF will begin to build, causing the coil current to decrease. When the coil current drops to approximately 50 percent of the desired current, i.e., time 320, the comparators in the current sensing circuit 125 will turn "off" one at a time, as explained above. Approximately 40 milliseconds after the first comparator 210 turns "off" and capacitor C26 begins to charge, the relay contacts 130 will be closed. At some time prior to this, the IGBT 110 will have opened and the remaining coil current will decay to zero, indicating that the closing operation has been completed.

Figure 4:
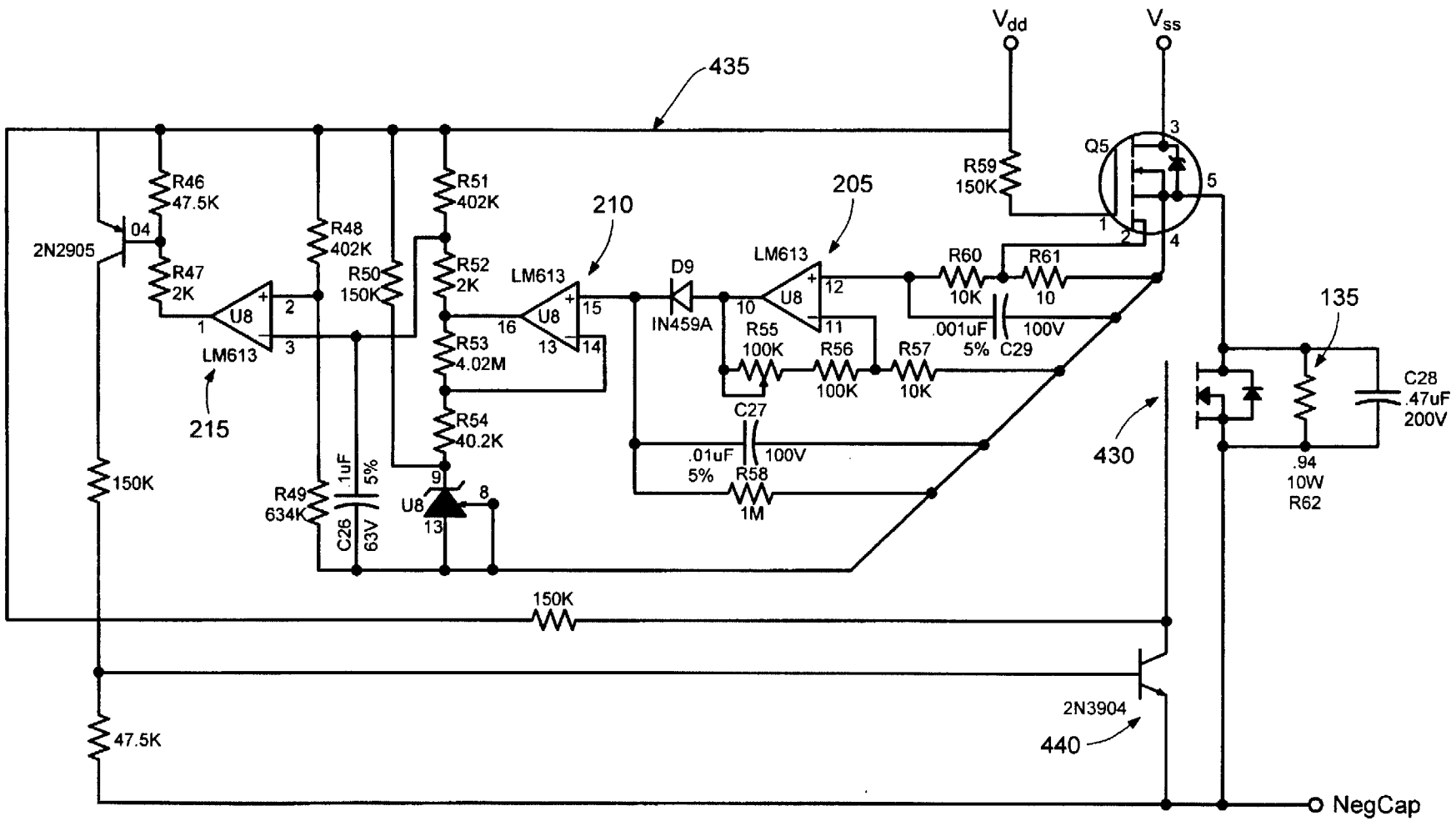
FIG. 4 illustrates an alternative embodiment wherein a field effect transistor is used to divert coil current through a current optimizing resistor.

FIG. 4 illustrates an alternative embodiment, wherein a field effect transistor (FET) 430 is utilized for diverting coil current through the current optimizing resistor 135, in lieu of the one or more relay contacts 130. FET 430 is normally in an ON state (i.e., conducting), such that current flowing through the actuator coil by-passes the current optimizing resistor 135. When the current sensing circuit 435, similar to the current sensing circuit 125, detects that an optimum amount of current is flowing through the actuator coil, the current sensing circuit 435 activates transistor 440 (i.e., causes transistor 440 to transition from an OFF state to an ON state). This, in turn, causes FET 430 to transition from the ON state to the OFF state, and the current flowing through the actuator coil will be diverted through the current optimizing resistor 135.

It should be noted that the specific voltages, resistances, and capacitances described above are exemplary. One of ordinary skill in the art will readily understand that other values may be used without departing from the spirit of the present invention. Likewise, one of ordinary skill in the art will also recognize that other components may be substituted for those used to describe the exemplary embodiment without departing from the spirit of the present invention. Most notably, devices other than the sensefet may be used for detecting minimum current, and devices other than a capacitor may be used as an energy source, for example, batteries or DC power supplies.

What is claimed is:

1. A device for limiting an electrical switchgear closing velocity comprising:

an energy source;

an actuator means connected in series with said energy source, wherein said actuator means mechanically operates the electrical switchgear and movement of said actuator means occurs at a velocity which is related to a current flowing there through;

current sensing means connected to said actuator means for detecting whether said current has reached a predetermined amount;

current optimizing impedance means; and means for inserting said current optimizing impedance means in series with said energy source and said actuator means in response to said current sensing means detecting the predetermined amount of current flowing through said actuator means to limit said velocity of said electrical switchgear closing.

2. The device of claim 1, wherein the impedance value of said current optimizing impedance means is such that the flow of current through said current optimizing impedance means prevents the current flowing through said actuator means from exceeding the predetermined amount of current, thus limiting the closing velocity of the electrical switchgear.

3. The device of claim 1, wherein said current optimizing impedance means is a current optimizing resistor.

4. A device in accordance with claim 1, wherein said actuator means is a solenoid.

5. A device in accordance with claim 1, wherein said actuator means is an electro-magnetic actuator.

6. A device in accordance with claim 5, wherein said electro-magnetic actuator is a bi-stable magnetic actuator.

7. A device in accordance with claim 1, wherein said energy source is a capacitor charged by a battery.

8. The device in accordance with claim 1, wherein said current sensing means comprises:

means for triggering said current optimizing insertion means.

9. An electronic circuit for limiting an electrical switchgear closing velocity comprising:

an energy source;

an electro-magnetic actuator comprising a permanent magnet, a coil, and a plunger, wherein said coil is connected in series with said energy source and said plunger mechanically controls the closure of the electrical switchgear when the energy source discharges its energy through said electro-magnetic actuator;

a coil current sensing circuit connected to said electro-magnetic actuator for detecting whether a predetermined amount of current is flowing through the coil of said electro-magnetic actuator;

a current optimizing resistor; and means for inserting said current optimizing resistor in series with said energy source and said coil in response to the coil current sensing circuit detecting the predetermined amount of current flowing through said coil to limit said electrical switchgear closing velocity by limiting a speed at which said plunger moves.

10. The electronic circuit of claim 9, wherein the impedance value of said current optimizing resistor is such that, when the current optimizing resistor is inserted in series with said energy source and said coil, the flow of current through said electro-magnetic actuator is prevented from exceeding the predetermined amount of current required to operate the plunger, and causes the coil current through said electro-magnetic actuator to follow a predetermined coil current profile.

11. An electronic circuit in accordance with claim 9, wherein said means for inserting said current optimizing resistor in series with said energy source and said coil comprises:

a field effect transistor coupled in parallel with said current optimizing resistor, wherein when said field effect transistor is turned off, said current optimizing resistor is inserted in series with said energy source and said coil.

12. An electronic circuit in accordance with claim 9, wherein said means for inserting said current optimizing resistor in series with said energy source and said coil comprises:

at least one electrical relay switch coupled in parallel with said current optimizing resistor, wherein when said electrical relay switch is open, said current optimizing resistor is inserted in series with said energy source and said coil.

13. An electronic circuit in accordance with claim 9, further comprising:

a current clearing capacitor connected in parallel with said current optimizing resistor, wherein said current clearing capacitor helps clear the current flowing through said current optimizing resistor when said current optimizing resistor is inserted in series with said energy source and said coil.

14. An electronic circuit in accordance with claim 9, wherein said coil current sensing circuit comprises:

a sensefet that generates a signal proportional to the coil current;

an amplification stage that amplifies the signal proportional to the coil current;

comparator means for comparing the amplified signal to a bias voltage and generating a corresponding output signal when the coil current reaches the predetermined amount of current flowing through said coil; and control means for actuating said means for inserting said current optimizing resistor in series with said energy source and said coil as a function of the comparator means output signal.

15. The electronic circuit in accordance with claim 9, wherein said coil current sensing circuit comprises:

control means for triggering said current optimizing resistor insertion means.

16. A method for limiting an electrical switchgear closing velocity comprising the steps of:

generating a coil current through an actuator, wherein the actuator is connected to the electrical switchgear;

detecting whether the coil current has reached a predetermined amount of current for operating the actuator; and limiting the coil current to a predefined coil current profile, thereby limiting the closing velocity of the electrical switchgear in accordance with the predefined coil current profile, wherein said step of limiting the coil current to the predetermined coil current profile, comprises the step of diverting the coil current through a resistor when the predefined amount of current required to operate the actuator has been detected.

17. A method in accordance with claim 16, wherein the resistor is a current optimizing resistor.

18. An apparatus for controlling an electrical switchgear closing velocity comprising:

an energy source;

an actuator means connected in series with said energy source, wherein said actuator means mechanically operates the electrical switchgear;

current sensing circuit connected to said actuator means for detecting an amount of current flowing through said actuator means; and means for optimizing the electrical switch gear closing velocity responsive to said current sensing means, wherein said means for optimizing the electrical switchgear closing velocity comprises an impedance and means for inserting said impedance in series with said energy source and said actuator means.

19. An apparatus in accordance with claim 18, wherein the impedance is a current optimizing impedance.

* * * * *